US006783427B2

(12) United States Patent
Isobe et al.

(10) Patent No.: US 6,783,427 B2
(45) Date of Patent: Aug. 31, 2004

(54) POLISHING SYSTEM WITH AIR EXHAUST SYSTEM

(75) Inventors: Soichi Isobe, Kanagawa (JP); Tadakazu Sone, Kanagawa (JP); Takuji Hayama, Kanagawa (JP); Manabu Tsujimura, Kanagawa (JP)

(73) Assignee: Ebara Corporation, Tokyo (JP)

( * ) Notice: Subject to any disclaimer, the term of this patent is extended or adjusted under 35 U.S.C. 154(b) by 15 days.

(21) Appl. No.: 10/277,131

(22) Filed: Oct. 22, 2002

(65) Prior Publication Data

US 2003/0077989 A1 Apr. 24, 2003

(30) Foreign Application Priority Data

Oct. 22, 2001 (JP) ..... 2001/323860

(51) Int. Cl.[7] ..... B24B 1/00

(52) U.S. Cl. ..... 451/5; 451/8; 451/9; 451/41; 451/65; 451/285; 134/902; 454/187

(58) Field of Search ..... 451/5, 8, 9, 41, 451/54, 65, 67, 285–296, 451, 453; 134/902, 2, 3, 95.1; 454/187

(56) References Cited

U.S. PATENT DOCUMENTS 5,655,954 A * 8/1997 Oishi et al. ..... 451/67
5,679,059 A * 10/1997 Nishi et al. ..... 451/41
6,110,024 A * 8/2000 Togawa ..... 451/285
6,116,986 A * 9/2000 Togawa et al. ..... 451/36
6,146,246 A * 11/2000 Custer et al. ..... 451/36
6,149,500 A * 11/2000 Takahashi et al. ..... 451/41
6,413,154 B1 * 7/2002 Togawa et al. ..... 451/285
6,428,400 B1 * 8/2002 Togawa et al. ..... 451/67
6,431,948 B1 * 8/2002 Atoh ..... 451/5
6,439,962 B1 * 8/2002 Ato ..... 451/6
6,494,768 B2 * 12/2002 Inaba ..... 451/287
6,616,512 B2 * 9/2003 Sotozaki ..... 451/54

FOREIGN PATENT DOCUMENTS

JP 2000-012493 1/2000
JP 2000-182949 6/2000

* cited by examiner

*Primary Examiner*—Joseph J. Hail, III
*Assistant Examiner*—Anthony Ojini
(74) *Attorney, Agent, or Firm*—Wenderoth, Lind & Ponack, L.L.P.

(57) ABSTRACT

A polishing apparatus comprises: a housing defining a chamber wherein articles to be polished are subject to polishing and cleaning operations; partition walls for dividing the chamber of the housing into a plurality of sections; and, an air exhaust device. The exhaust device comprises: air exhaust conduits which are fluidly connected to the sections in the housing to exhaust air from the sections; valves for closing and opening the air exhaust conduits, respectively; and, a controller for independently controlling the valves to regulate air flows exhausted through the conduits. The conduits have inlet openings located in a vicinity of spaces where any air pollutant is generated in the sections in the housing.

20 Claims, 2 Drawing Sheets

POLISHING SYSTEM WITH AIR EXHAUST SYSTEM

BACKGROUND OF THE INVENTION

This invention relates to a system for polishing articles such as semiconductor wafers, which is provided with an air exhaust system for creating a negative pressure in a housing of the polishing system.

During production of semiconductor devices, it is common to use a polishing system in which semiconductor wafers are subjected to a so-called chemical mechanical polishing (CMP) process to form a highly planarized surface for formation of an integrated circuit. During a chemical mechanical polishing process, semiconductor wafers are slidably engaged with and moved relative to a polishing surface, which surface is usually provided on an upper side of a turntable, and a chemical polishing liquid referred to as slurry is concurrently supplied onto the polishing surface.

Semiconductor devices are produced in a clean room, and a polishing system such as that mentioned above is installed in the clean room. During a polishing operation pollutants are generated, which may include: particles of polishing liquid scattered from a polishing surface; debris generated from a wafer or from a polishing surface; particles generated in driving assemblies for driving a turntable, and in cleaning machines for cleaning wafers which have been polished, and also in wafer transporting devices; and harmful gases emitted from a chemical cleaning liquid. It is necessary to prevent such pollutants from leaving a housing of the polishing system and entering the clean room. To this end, a pressure in the housing of the polishing system is kept lower than that in the clean room by exhausting or drawing out air from the housing.

However, since a volume of the housing of the polishing system is large, a large amount of energy is required to create a negative pressure in the housing relative to the clean room.

SUMMARY OF THE INVENTION

Accordingly, it is an object of the present invention to provide a polishing system with an air exhaust system which can efficiently exhaust or draw out air from a housing to create negative pressures in the housing, which are required to prevent pollutants, such as particles of a polishing liquid, from leaking from the housing.

According to one aspect of the present invention, there is provided a polishing system comprising:

- a housing defining a chamber in which articles to be polished are subject to polishing and cleaning operations;
- partition walls for dividing the chamber of the housing into a plurality of sections; and,
- an air exhaust device comprising:
  - air exhaust conduits which are fluidly connected to sections in the housing to exhaust air from the sections;
  - valves for closing and opening respective ones of the air exhaust conduits, the conduits having inlet openings located in a vicinity of spaces where any air pollutant is generated in the sections in the housing; and,
  - a controller for independently controlling the valves to regulate air flows exhausted through the conduits.

In the polishing system of the present invention, since the inlet openings of the conduits are positioned in a vicinity of spaces where an air pollutant may be generated in the polishing system housing, any air pollutant can be efficiently discharged from the housing to prevent leakage of the air pollutant from the housing into space of a clean room, even in a case that a negative pressure employed in the housing is not as great as that employed in a housing of a conventional polishing system having an air exhaust system. Further, in the polishing system of the present invention, it is possible to independently control the valves. This makes it possible for the air exhaust system to perform an efficient and effective air exhaust operation, by conducting such an operation on a basis of various conditions such as an air pressure in various sections in the housing of the polishing system, a degree of air pollutants in the sections, and the like.

BRIEF DESCRIPTION OF THE DRAWINGS

Further objects and advantages of the present invention will be apparent from the following description made with reference to the accompanying drawings showing a preferred embodiment of the present invention.

In the Drawings

DETAILED DESCRIPTION OF THE PREFERRED EMBODIMENTS

Figure 1:
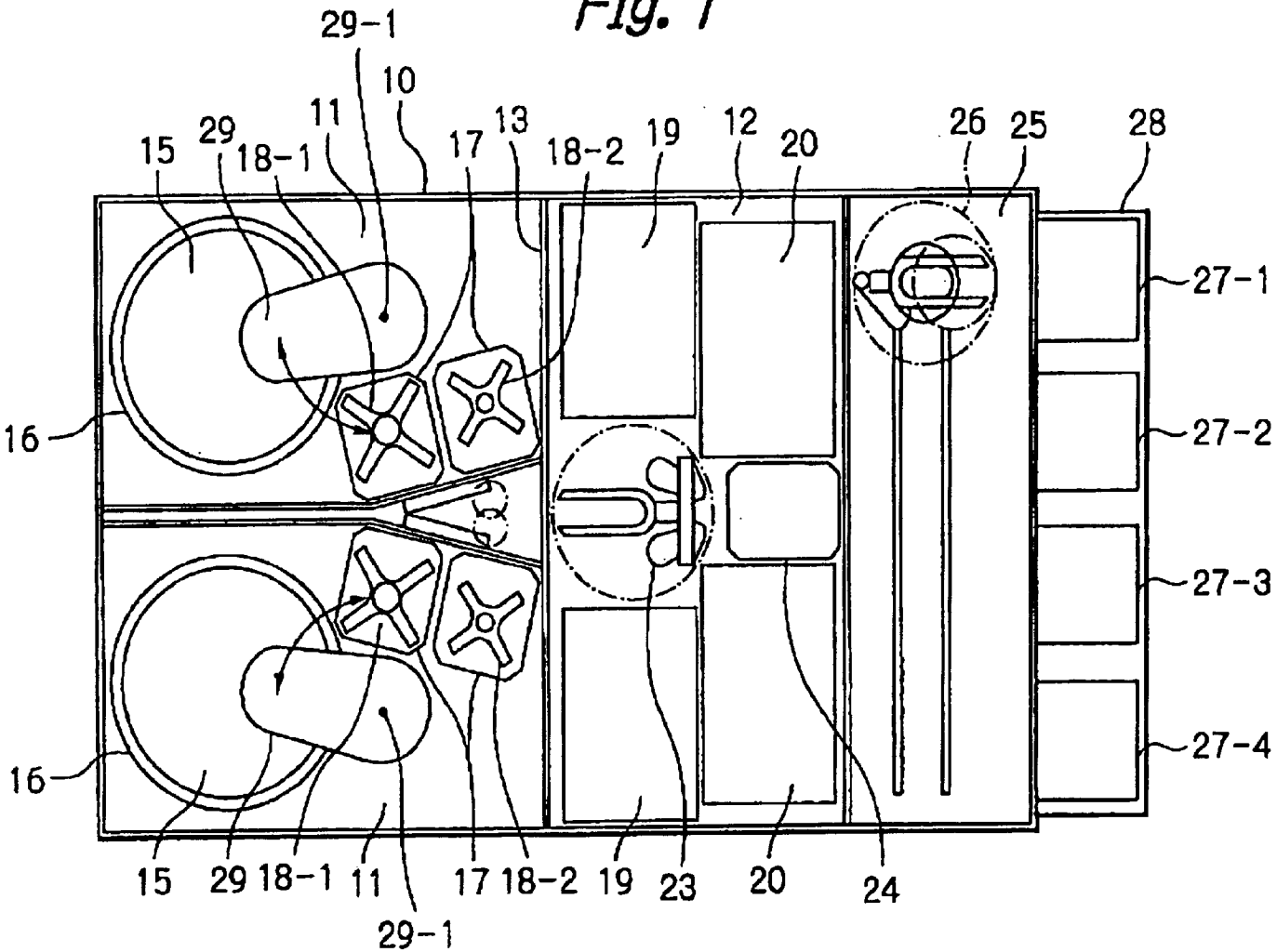
FIG. 1 is a top plan view of a polishing system in accordance with an embodiment of the subject invention, with a ceiling wall of a housing of the polishing system cut away to provide a clear view of an interior of the housing; and, FIG. 2 is a schematic cross sectional side elevational view of a main portion of the polishing system of FIG. 1 showing an air exhaust system installed in the polishing system.
Figure 2:
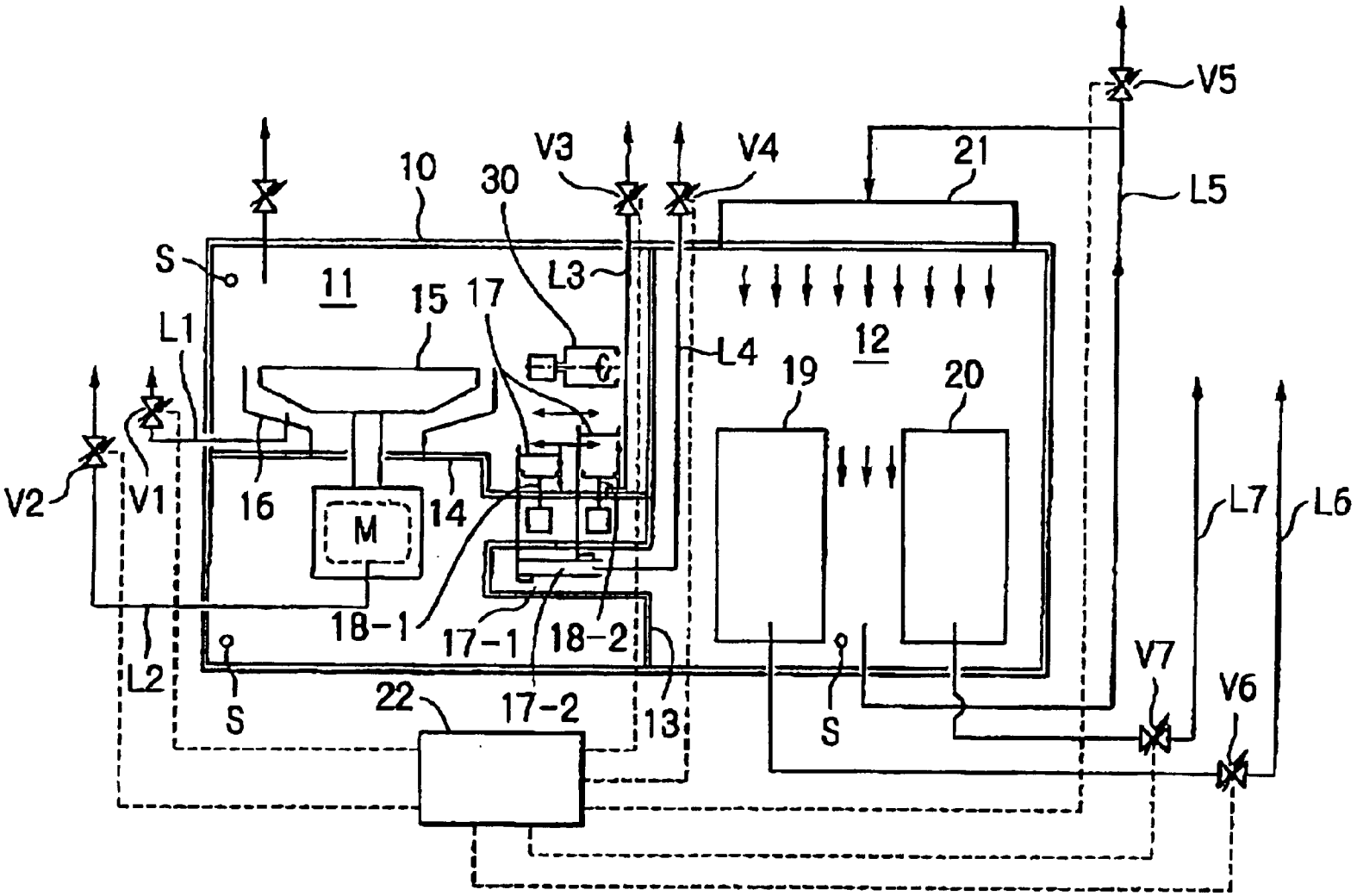

As shown in FIGS. 1 and 2, a polishing system in accordance with a preferred embodiment of the present invention has a housing 10 which is divided by partition walls 13 into a pair of polishing sections 11, 11, a cleaning section 12 and a wafer intake/outtake section 25. An exterior of the wafer intake/outtake section 25 is adapted to receive wafer storage cassettes 27-1, 27-1, 27-3 and 27-4.

In each of the polishing sections 11, 11, a turntable 15 is provided, along with a motor M for drivingly rotating the turntable 15 about its vertical axis. As shown in FIG. 2, each polishing section is divided by a partition wall 14 into an upper area in which the turntable 15 is provided, with a cup-like slurry drainage member 16 being provided to surround the turntable 15, and a lower area in which the motor M is provided. Each of the polishing sections 11, 11 is further provided with a wafer carrier 29, and a pair of wafer transfer trays 17, 17 adapted to be horizontally moved by corresponding motors such as air cylinders 17-1, 17-2 to either a left position or a right position, as shown in FIG. 1. The wafer carrier 29 is pivotable about a vertical axis 29-1 between a position shown in FIG. 1 where the wafer carrier brings a wafer into contact with a polishing surface provided on an upper side surface of the turntable 15, and a position where the wafer carrier 29 is positioned above the wafer transfer tray 17 at the left position to receive a pre-polishing wafer from the wafer tray 17, or to return a post-polishing wafer onto the wafer tray 17. In FIG. 2, reference numeral 18-1 denotes a first wafer lift having a motor such as an air cylinder provided at its lower end for moving the first wafer lift either up or down to transfer a wafer from the wafer tray 17 at the left position to the wafer carrier 29, and vice versa. Reference numeral 18-2 denotes a second wafer lift which is also provided at its lower end with a motor for moving the second wafer lift 18-2 either up or down to transfer a wafer from the wafer tray 17 at the right position to a reverser 30 provided over the wafer tray 17, and vice versa. The reverser 30 is adapted to turn upside down a wafer received from a transfer robot 23 provided inside the cleaning section 12 (to be described in detail later) to pass the wafer to the second wafer lift 18-2, and also to turn upside down a wafer received from the second wafer lift 18-2 to pass it to the transfer robot 23.

In the cleaning section 12, provided is a pair of primary cleaning machines 19, 19 along with a pair of secondary cleaning machines 20, 20 arranged in tandem. In a central area of the cleaning section 12, there are provided the transfer robot 23 and a wafer table 24. The transfer robot 23 is adapted to pick up a pre-polishing wafer, supplied onto the table 24 from the wafer intake/outtake section 25, and transfer it to reverser 30 in polishing section 11, and to take a polished wafer from the reverser 30 to transfer it first to primary cleaning machine 19, and then to secondary cleaning machine 20. Each secondary cleaning machine 20 can perform a spin-drying operation in addition to a wafer cleaning operation so that a wafer is substantially completely dried thereby.

In the wafer intake/outtake section 25, there is provided a transfer robot 26 adapted to remove a pre-polishing wafer from any one of the wafer storage cassettes 27-1, 27-2, 27-3 and 27-4 and place it on the wafer table 24 in the cleaning section 12, and to take a polished wafer from secondary cleaning machine 20 and return it to one of the wafer storage cassettes.

FIG. 2 shows an air exhaust system provided in the polishing system. The air exhaust system comprises a plurality of conduits L1, L2, L3, L4, L5, L6, and L7 that are fluidly connected to the housing 10; specifically, to the upper and lower parts of each polishing section 11 and the cleaning section 12 of the housing. The conduits L1, L2, L3, L4, L5, L6, and L7 have outlet openings (not shown) connected to an air draw device (not shown), for example a vacuum pump, and input openings which are, with the exception of conduit L5, positioned in a vicinity of spaces where an air pollutant is generated. Specifically, the inlet opening of each conduit L1 is provided in slurry drainage member 16 near turntable 15 since during a polishing operation polishing liquid and debris are scattered from both a wafer being polished and the polishing surface. The inlet opening of each conduit L2 is open to an interior of a motor casing enclosing a drive assembly of motor M, since particles may be generated therefrom as a result of frictional engagement between movable elements of the drive assembly. The inlet openings of each conduit L4 and each conduit L3 are positioned near air cylinders or motors 17-1, 17-2 of wafer trays 17, 17, and the air cylinders or motors of lifts 18-1, 18-2, respectively. The inlet openings of each conduit L6 and each conduit L7 are open to an interior of primary and secondary cleaning machines 19, 20, respectively. The conduits L1, L2, L3, L4, L5, L6, and L7 are provided with valves V1, V2, V3, V4, V5, V6, and V7, respectively, which are connected to a controller 22 for controlling opening and closing of the valves V1, V2, V3, V4, V5, V6, and V7 to independently regulate air exhausted through the conduits L1, L2, L3, L4, L5, L6, and L7.

The conduit L5 is provided with a return branch to return air drawn from the cleaning section 12 to the same section through a filter 21 mounted on a top of the housing 10. Each polishing section 11 is provided with an additional air vent conduit (not denoted by any reference numeral) at a left upper portion thereof.

Operation of the air exhaust system described above will now be explained. As stated above, to maintain a negative pressure inside of the system housing 10 relative to a clean room to prevent air leakage from the system housing 10 into the clean room, it is essential for the air exhaust system to be operated. Further, the air exhaust system is capable of generating different pressures in different sections in the system housing 10 divided by the partition walls 13 and 14. Specifically, a pressure in polishing section 11 which, generally, is most susceptible to contamination by air pollutants, is made lower than that in the cleaning section 12. Although no air exhaust conduits for the wafer intake/outtake section 25 are shown, pressure in the section 25 is also controlled by virtue of air vent conduits similar to those described above. Specifically, the section 25 is usually kept at a higher pressure than the clean room as well as the sections 11 and 12. An air supply system (not shown) may be provided to supply clean air from outside to the section 25 to, for example, keep this section at a high pressure relative to the other sections 11 and 12 and the clean room.

The controller 22 controls the valves V1, V2, V3, V4, V5, V6, and V7 taking into account air pressure and/or air contaminant conditions in respective spaces in the system housing; and it is possible to selectively open any of the valves V1, V2, V3, V4, V5, V6, and V7. For example, during a polishing operation, only valves V1 and V7 will be opened when it is determined that it is sufficient to exhaust air through the conduits L1 and L7 to prevent pollutants generated during the polishing operation from leaking into the clean room. Such control of the valves leads to an effective saving of energy expended in creating negative pressures needed to prevent pollutant leakage into the clean room. Further, during a waiting period for a next polishing operation, only valve V1 may be opened while the other valves are closed, as it is generally unnecessary to conduct air exhaust through the conduits L2–L7. In a polishing system in accordance with this embodiment, while a total amount of air to be exhausted through all of the conduits L1, L2, L3, L4, L5, L6, and L7 amounts to 52 $m^3$, an amount of air exhausted through conduits L1 amounts to 11$m^3$, whereby energy for exhausting air from the polishing system is greatly decreased.

Furthermore, it is possible to open the valves V1, V2, V3, V4, V5, V6, and V7 intermittently during an air-exhaust operation.

Control of the valves V1, V2, V3, V4, V5, V6, and V7 may be performed on a basis of air pressures in the housing sensed by pressure sensors S provided at predetermined positions in the housing. Specifically, valve control may be conducted on a basis of comparison of sensed pressures with predetermined pressure values. Although a specific embodiment of the present invention has been described in the foregoing, it should be understood that the present invention is not limited to this embodiment, and a variety of modifications and changes are possible within the spirit and scope of the present invention. For example, the valve control as described above will be applicable to control an air supply conduit system with which the polishing system described above may be provided, to the extent that a controller independently controls valves provided in respective air supply conduits of the air supply conduit system which are fluidly connected to respective sections of the housing of the polishing system. Further, it should be noted that the present invention is applicable to apparatuses as disclosed in Japanese Patent Applications 7-344797, 9-33784, 11-545612, 10-189704 and 2000-250392.

What is claimed is:

1. A polishing apparatus comprising:

a housing defining a chamber wherein articles are to be subjected to polishing and cleaning operations;

at least one partition wall for dividing said chamber into sections;

pressure sensors provided at predetermined positions in said housing; and an air exhaust device including (i) air exhaust conduits fluidly connected to said sections to exhaust air from said sections; said air exhaust conduits having inlet openings located in a vicinity of spaces where an air pollutant can be generated in said sections, (ii) valves for closing and opening said air exhaust conduits, respectively and (iii) a controller for independently controlling said valves on a basis of comparison of pressures sensed by said pressure sensors with predetermined pressure values so as to regulate air flows exhausted through said air exhaust conduits, such that different pressures can be generated in different ones of said sections.

2. The polishing apparatus according to claim 1, wherein said controller is adapted to selectively open said valves to exhaust air from the spaces which are desired to be air-exhausted.

3. The polishing apparatus according to claim 2, wherein said sections comprise a polishing section and a cleaning section, with (i) said polishing section being provided with a turntable having on one of its sides a polishing surface, and a motor for drivingly rotating the turntable, and (ii) said cleaning section being provided with a cleaning machine for cleaning semiconductor wafers which have been subjected to a polishing operation, and said air exhaust conduits are fluidly connected to said polishing section and said cleaning section, respectively, with said air exhaust conduit fluidly connected to said polishing section having an inlet opening positioned in the vicinity of said turntable.

4. The polishing apparatus according to claim 3, wherein said polishing section has a polishing operation section and a motor section divided by a partition wall so that said turntable is positioned in said polishing operation section and said motor is positioned in said motor section, and said air exhaust conduits include a conduit fluidly connected to an interior of a housing of said motor to exhaust air therefrom.

5. The polishing apparatus according to claim 4, wherein said air exhaust conduits include a conduit fluidly connected to an interior of said cleaning machine to exhaust air therefrom.

6. The polishing apparatus according to claim 3, wherein said air exhaust conduits include a conduit fluidly connected to an interior of said cleaning machine to exhaust air therefrom.

7. The polishing apparatus according to claim 1, wherein said controller is adapted to control at least one of said valves intermittently.

8. The polishing apparatus according to claim 7, wherein said sections comprise a polishing section and a cleaning section, with (i) said polishing section being provided with a turntable having on one of its sides a polishing surface, and a motor for drivingly rotating said turntable, and (ii) said cleaning section being provided with a cleaning machine for cleaning semiconductor wafers which have been subjected to a polishing operation, and said air exhaust conduits are fluidly connected to said polishing section and said cleaning section, respectively, with said air exhaust conduit fluidly connected to said polishing section having an inlet opening positioned in the vicinity of said turntable.

9. The polishing apparatus according to claim 8, wherein said polishing section has a polishing operation section and a motor section divided by a partition wall so that said turntable is positioned in said polishing operation section and said motor is positioned in said motor section, and said air exhaust conduits include a conduit fluidly connected to an interior of a housing of said motor to exhaust air therefrom.

10. The polishing apparatus according to claim 9, wherein said air exhaust conduits include a conduit fluidly connected to an interior of said cleaning machine to exhaust air therefrom.

11. The polishing apparatus according to claim 8, wherein said air exhaust conduits include a conduit fluidly connected to an interior of said cleaning machine to exhaust air therefrom.

12. The polishing apparatus according to claim 1, wherein said sections comprise a polishing section and a cleaning section, with (i) said polishing section being provided with a turntable having on one of its sides a polishing surface, and a motor for drivingly rotating said turntable, and (ii) said cleaning section being provided with a cleaning machine for cleaning semiconductor wafers which have been subjected to a polishing operation, and said air exhaust conduits are fluidly connected to said polishing section and said cleaning section, respectively, with said air exhaust conduit fluidly connected to said polishing section having an inlet opening positioned in the vicinity of said turntable.

13. The polishing apparatus according to claim 12, wherein said polishing section has a polishing operation section and a motor section divided by a partition wall so that said turntable is positioned in said polishing operation section and said motor is positioned in said motor section, and said air exhaust conduits include a conduit fluidly connected to an interior of a housing of said motor to exhaust air therefrom.

14. The polishing apparatus according to claim 13, wherein said air exhaust conduits include a conduit fluidly connected to an interior of said cleaning machine to exhaust air therefrom.

15. The polishing apparatus according to claim 12, wherein said air exhaust conduits include a conduit fluidly connected to an interior of said cleaning machine to exhaust air therefrom.

16. A polishing apparatus comprising:

a housing defining a chamber wherein articles are to be subjected to polishing and cleaning operations;

at least one partition wall for dividing said chamber into sections;

pressure sensors provided at predetermined positions in said housing; and an air exhaust device including (i) air exhaust conduits fluidly connected to said sections to exhaust air from said sections, said air exhaust conduits respectively having inlet openings at least one of which is located in a vicinity of a space where an air pollutant can be generated in at least one of said sections, (ii) valves for closing and opening said air exhaust conduits, respectively, and (iii) a controller for controlling at least one of said valves on a basis of comparison of pressures sensed by said pressure sensors with predetermined pressure values so as to regulate an air flow exhausted through said at least one of said air exhaust conduits, such that different pressures can be generated in different ones of said sections.

17. The polishing apparatus according to claim 16, wherein said sections comprise a polishing section and a cleaning section, with (i) said polishing section being provided with a turntable having on one of its sides a polishing surface, and a motor for drivingly rotating said turntable, and (ii) said cleaning section being provided with a cleaning machine for cleaning semiconductor wafers which have been subjected to a polishing operation, and said air exhaust conduits are fluidly connected to said polishing section and said cleaning section, respectively, with said air exhaust conduit fluidly connected to said polishing section having an inlet opening positioned in the vicinity of said turntable.

18. The polishing apparatus according to claim 17, wherein said polishing section has a polishing operation section and a motor section divided by a partition wall so that said turntable is positioned in said polishing operation section and said motor is positioned in said motor section, and said air exhaust conduits include a conduit fluidly connected to an interior of a housing of said motor to exhaust air therefrom.

19. The polishing apparatus according to claim 18, wherein said air exhaust conduits include a conduit fluidly connected to an interior of said cleaning machine to exhaust air therefrom.

20. The polishing apparatus according to claim 17, wherein said air exhaust conduits include a conduit fluidly connected to an interior of said cleaning machine to exhaust air therefrom.

* * * * *